United States Patent [19]

Sugimoto et al.

[11] Patent Number: 4,675,278

[45] Date of Patent: Jun. 23, 1987

[54] SILVER HALIDE PHOTOGRAPHIC LIGHT-SENSITIVE MATERIALS

[75] Inventors: Naohiko Sugimoto; Kunio Ishigaki, both of Kanagawa, Japan

[73] Assignee: Fuji Photo Film Co., Ltd., Kanagawa, Japan

[21] Appl. No.: 918,642

[22] Filed: Oct. 10, 1986

Related U.S. Application Data

[63] Continuation of Ser. No. 763,173, Aug. 7, 1985, abandoned.

[30] Foreign Application Priority Data

Aug. 7, 1984 [JP] Japan ..... 59-165083

[51] Int. Cl.[4] ..... G03C 1/76

[52] U.S. Cl. ..... 430/523; 430/527; 430/531; 430/950; 430/961

[58] Field of Search ..... 430/523, 950, 961, 527, 430/531

[56] References Cited

U.S. PATENT DOCUMENTS

| | | | |
|---|---|---|---|
| 4,004,927 | 1/1977 | Yamamoto et al. | 430/529 |
| 4,047,958 | 9/1977 | Yoneyama et al. | 430/527 |
| 4,190,449 | 2/1980 | Naoi et al. | 430/539 |
| 4,264,719 | 4/1981 | Kameoka et al. | 430/961 |
| 4,510,233 | 4/1985 | Yokoyama et al. | 430/527 |
| 4,518,354 | 5/1985 | Yokoyama et al. | 430/527 |

*Primary Examiner*—Jack P. Brammer

*Attorney, Agent, or Firm*—Sughrue, Mion, Zinn, Macpeak & Seas

[57] ABSTRACT

In silver halide photographic light-sensitive materials comprising at least one silver halide photographic emulsion layer on one side of a base and an emulsion protective layer thereon, and a hydrophilic colloid backing layer on the other side of the base, the improvement wherein said backing layer contains a polymer matting agent having an average particle size of 3.0 μm or more and said emulsion protective layer contains at least one of a polyoxyethylene type surface active agent, and a silicone type slipping agent.

8 Claims, No Drawings

SILVER HALIDE PHOTOGRAPHIC LIGHT-SENSITIVE MATERIALS

This is a continuation of application Ser. No. 06/763,173, filed Aug. 7, 1985, now abandoned.

FIELD OF THE INVENTION

The present invention relates to silver halide photographic light-sensitive materials and, particularly, to photographic light-sensitive materials having improved surface properties.

BACKGROUND OF THE INVENTION

Since photographic light-sensitive materials are generally composed of an electrically insulating base and a photographic layer, electrostatic charge is often accumulated by contact friction between the same substances or different substances or by separation thereof in the step of production of the photographic light-sensitive material or in the case of using it. The accumulated electrostatic charge causes many troubles. The most serious trouble is formation of dotted spots or branched or feathery line specks in the case of developing the exposed photographic film, because of the discharging of the accumulated electrostatic charge. This trouble is the so-called static mark, by which commercial value of the photographic films is greatly damaged and is sometimes lost. It will be easily recognized that very dangerous consequences can arise when such appears on, for example, medical or industrial X-ray films and the like. This phenomenon is a very troublesome problem, because it is not seen until development is carried out. Further, the accumulated electrostatic charge becomes a cause of inducing a secondary problem in that dust adheres to the surface of the films or uniform coating cannot be carried out.

The electrostatic charge is frequently accumulated, as described above, in the case of producing or using the photographic light-sensitive materials. For example, in the step of production, it is generated by contact friction between the photographic film and rollers or by separation of the emulsion face from the base face in the step of winding or rewinding the photographic film. Further, it is generated by contact with or separation from mechanical parts or fluorescent sensitizing paper in an automatic camera for X-ray films. In the case of photocomposing films or photocomposing papers, it is generated by contact with or separation from rollers made of rubber, metal or plastics, etc., in a computer photocomposing machine or a glass plate on CRT. In addition, it is generated by contact with packing materials. The static mark on the photographic light-sensitive materials derived by accumulation of the electrostatic charge becomes remarkable with an increase of sensitivity of the photographic light-sensitive material and an increase of the processing rate. Particularly, in recent years, generation of the static mark is more easily caused because the photographic light-sensitive materials are highly sensitized and there are many opportunities of being subject to severe handling such as high speed coating, high speed photographing or high speed automatic processing, etc.

In order to remove these troubles due to electrostatic charge, it is preferred to add an antistatic agent to the photographic light-sensitive materials. However, antistatic agents used conventionally in other fields cannot be used as antistatic agents for photographic light-sensitive materials since they are subject to various restrictions for photographic light-sensitive materials. Namely, an antistatic agent for use with a photographic light-sensitive material is required to have not only excellent antistatic properties but also performances such that it does not have a bad influence upon the photographic characteristics, for example, sensitivity, fog, granularity and sharpness, etc., of the photographic light-sensitive materials; it does not have a bad influence upon the film strength of the photographic light-sensitive materials (namely, the film is not easily injured by rubbing or scratching); it does not have a bad influence upon adhesive resistance (namely, the photographic light-sensitive material does not easily adhere to the surface each other or to the surface of another substance); it does not accelerate fatigue of processing solutions for the photographic light-sensitive materials; and it does not deteriorate the adhesive strength between constituent layers in the photographic light-sensitive material. Accordingly, it is subject to many restrictions in order to apply the antistatic agent to the photographic light-sensitive materials.

A way to remove problems caused by static electricity is to increase the electrical conductivity of the surface of the light-sensitive material so that the electrostatic charge disappears within a short time prior to discharging the accumulated electric charge.

Therefore, it has been considered hitherto to improve the conductivity of the base of the photographic light-sensitive materials or various kinds of coating surface layer thereof, and it has been attempted to utilize various hygroscopic substances or water-soluble inorganic salts, and certain kinds of surface active agents and polymers, etc. For example, it has been known to use polymers as described in U.S. Pat. Nos. 2,882,157, 2,972,535, 3,062,785, 3,262,807, 3,514,291, 3,615,531, 3,753,716, 2,938,999, etc., surface active agents as described in U.S. Pat. Nos. 2,982,651, 3,428,456, 3,457,076, 3,454,625, 3,552,972, 3,655,387, etc., and metal oxides and colloidal silica as described in U.S. Pat. Nos. 3,062,700, 3,245,833, 3,525,621, etc.

However, many of these substances show singularity to species of the film base or difference of photographic composition. Namely, there is a case that though it shows a good result in a certain kind of film base or photographic emulsion or a certain kind of photographic constituent element, but it does not serve for preventing generation of static electricity in another film base or photographic constituent element and has a bad influence upon the photographic properties.

On the other hand, there are many cases that, though the antistatic effect is very excellent, it cannot be used, because of having a bad influence upon photographic characteristics such as sensitivity, fog, granularity or sharpness, etc., of the photographic emulsion.

Accordingly, it is very difficult to apply the antistatic agents to photographic light-sensitive materials and use of them is often restricted to a certain region.

Nonionic surface active agents having a polyoxyethylene chain in the molecule described in British Pat. No. 861,134 and German Pat. No. 1,422,809 are known to have an excellent antistatic property.

On the other hand, the photographic light-sensitive materials are frequently subject to the undesirable influence of touching with a photographic apparatus such as various devices, machines or cameras, etc., or contact friction by adhesion materials such as dust or fibrous waste, etc., or contact friction of the photographic light-sensitive materials themselves, such as contact friction between the surface of the sensitive material and the back face in the case of handling such as rewinding or transferring in photographing, development processing, printing or projection, etc., including the step of production such as coating, drying or processing, etc.

For example, there is deterioration of the moving property of the sensitive material in the camera or other apparatus, or formation of waste of film in the camera or other apparatus.

Hitherto, various processes have been proposed in order to produce photographic light-sensitive materials having improved physical properties wherein the slipping friction of the photographic light-sensitive material is reduced so that the photographic light-sensitive material smoothly moves in a film magazine, a camera gate or a projector gate, etc.

For example, a process which comprises incorporating dimethylsilicone and a specified surface active agent together in a photographic emulsion layer or a protective layer to give a slipping property to the photographic film as described in U.S. Pat. No. 3,042,522, a process which comprises applying a mixture of dimethylsilicone and diphenylsilicone to the back face of the photographic film to give a slipping property as described in U.S. Pat. No. 3,080,317, and a process which comprises incorporating triphenyl end blocked methylphenylsilicone in a protective layer to give a slipping property to the photographic film as described in British Pat. No. 1,143,118 have been known.

However, since these compounds (polyoxyethylene type surface active agent or silicone type slipping agent) are localized in the surface and they are transferred so that they deteriorate the surface properties of the sensitive material when the sensitive material is brought in contact with another different material for a long time. Particularly, in the case of a photographic sensitive material having a hydrophilic colloid backing layer, the polyoxyethylene type surface active agent or the silicone type slipping agent incorporated in the emulsion protective layer is transferred to the backing layer during preservation by which the backing layer and the emulsion protective layer acquire electrification characteristics and slipping properties different from the prescribed surface properties. Consequently, the antistatic property and the slipping property remarkably deteriorate.

SUMMARY OF THE INVENTION

The first object of the present invention is to provide silver halide photographic light-sensitive materials having improved antistatic property and/or slipping property.

The second object of the present invention is to provide photographic light-sensitive materials comprising a hydrophilic colloid backing layer, which have excellent electrification characteristics and/or slipping property in the case of preserving for a long time.

These objects of the present invention have been attained by incorporating a polymer matting agent having an average particle size of 3.0 μm or more in the hydrophilic backing layer and incorporating at least one of a polyoxyethylene type surface active agent and a silicone type slipping agent in the emulsion protective layer.

DETAILED DESCRIPTION OF THE INVENTION

As typical examples of the polymer matting agent used in the present invention, there are water dispersive vinyl polymers such as polymethyl methacrylate, cellulose acetate propionate, starch and the like. It is particularly preferred to use a spherical matting agent of water dispersive vinyl polymers such as a homopolymer of acrylic (or methacrylic) acid ester (e.g., methyl methacrylate, glycidyl acrylate or glycidyl methacrylate), or a copolymer of these acrylic (or methacrylic) acid esters or with other vinyl monomers.

As the polyoxyethylene type surface active agents used in the emulsion protective layer of the present invention, there are compounds represented by the following general formulae (I-1), (I-2) and (I-3):

$$R_1-A\text{-}(CH_2CH_2O)_{n_1}\text{-}H \qquad \text{(I-1)}$$

(I-2)

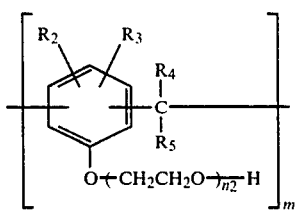

(I-3)

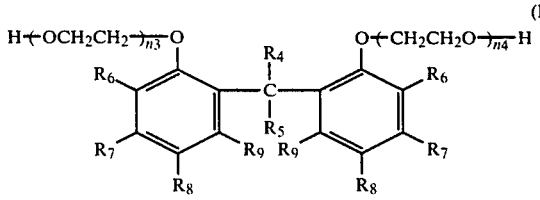

wherein $R_1$ represents a substituted or unsubstituted alkyl group having 1 to 30 carbon atoms, a substituted or unsubstituted alkenyl group or a substituted or unsubstituted aryl group, A represents —O—, —S—, —COO—, $$-\underset{|}{N}-R_{10},\quad -CO-\underset{|}{N}-R_{10}\quad \text{or}\quad -SO_2\underset{|}{N}-R_{10}$$

(wherein $R_{10}$ represents a hydrogen atom or a substituted or unsubstituted alkyl group; $R_2$, $R_3$, $R_7$ and $R_9$ each represents a hydrogen atom, a substituted or unsubstituted alkyl group, a substituted or unsubstituted aryl group, a substituted or unsubstituted alkoxy group, a halogen atom, an acyl group, an amide group, a sulfonamide group, a carbamoyl group or a sulfamoyl group; $R_6$ and $R_8$ each represents a substituted or unsubstituted alkyl group, a substituted or unsubstituted aryl group, a substituted or unsubstituted alkoxy group, a halogen atom, an acyl group, an amide group, a sulfonamide group, a carbamoyl group or a sulfamoyl group; $R_4$ and $R_5$ each represents a hydrogen atom, a substituted or unsubstituted alkyl group or a substituted or unsubstituted aryl group, $R_4$ and $R_5$, $R_6$ and $R_7$, and $R_8$ and $R_9$ may form a substituted or unsubstituted ring by bonding together, and $n_1$, $n_2$, $n_3$, $n_4$ and m each represents a number of 2 to 50.

In the general formula (I-3), substituents on the phenyl groups may be asymmetric.

Preferred examples in the present invention are described in the following. Preferred examples of $R_1$ include alkyl groups having 4 to 24 carbon atoms, alkenyl groups and alkylaryl groups and particularly preferred examples include a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, an m-pentadecaphenyl group, a t-octylphenyl group, a 2,4-dinonylphenyl group, an octylnaphthyl group, etc.

Preferred examples of $R_2$, $R_3$, $R_6$, $R_7$, $R_8$ and $R_9$ include substituted or unsubstituted alkyl groups having 1 to 20 carbon atoms such as a methyl, ethyl, i-propyl, t-butyl, t-amyl, t-hexyl, t-octyl, nonyl, decyl, dodecyl, trichloromethyl, tribromomethyl, 1-phenylethyl or 2-phenyl-2-propyl group, etc., substituted or unsubstituted aryl groups such as a phenyl group, a p-chlorophenyl group, etc., substituted or unsubstituted alkoxy groups represented by $-OR_{11}$ (wherein $R_{11}$ represents a substituted or unsubstituted alkyl group having 1 to 20 carbon atoms or a substituted or unsubstituted aryl group, hereinafter, the same meaning), halogen atoms such as a chlorine atom, a bromine atom, etc., acyl groups represented by $-COR_{11}$, amide groups represented by $-NR_{12}COR_{11}$ (wherein $R_{12}$ represents a hydrogen atom or a substituted or unsubstituted alkyl group having 1 to 20 carbon atoms, hereinafter the same meaning), sulfonamide groups represented by $-NR_{12}SO_2R_{11}$, carbamoyl groups represented by

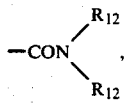

and sulfamoyl groups represented by

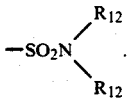

$R_2$, $R_3$, $R_7$ and $R_9$ may be each a hydrogen atom. Among them, preferred examples of $R_6$ and $R_8$ include alkyl groups and halogen atoms, and particularly preferred examples include bulky tertiary alkyl groups such as a t-butyl group, a t-amyl group, a t-octyl group, etc. A particularly preferred example of $R_7$ and $R_9$ is a hydrogen atom. Namely, compounds represented by the general formula (I-3) synthesized from 2,4-disubstituted phenols are particularly preferred to use.

Preferred examples of $R_4$ and $R_5$ include a hydrogen atom, substituted or unsubstituted alkyl groups such as a methyl group, an ethyl group, an n-propyl group, an i-propyl group, an n-heptyl group, a 1-ethylamyl group, an n-undecyl group, a trichloromethyl group, a tribromomethyl group, etc., and substituted or unsubstituted aryl groups such as an $\alpha$-furyl group, a phenyl group, a naphthyl group, a p-chlorophenyl group, a p-methoxyphenyl group, an m-nitrophenyl group, etc.

$R_4$ and $R_5$, $R_6$ and $R_7$ or $R_8$ and $R_9$ may form a substituted or unsubstituted ring by bonding together, an example of which is a cyclohexyl ring. Particularly preferred examples of $R_4$ and $R_5$ include a hydrogen atom, alkyl groups having 1 to 8 carbon atoms, a phenyl group and a furyl group.

$n_1$, $n_2$, $n_3$ and $n_4$ are particularly preferred to be a number of 5 to 30. $n_3$ and $n_4$ may be identical or different from each other.

These compounds are described in, for example, U.S. Pat. Nos. 2,982,651, 3,428,456, 3,457,076, 3,454,625, 3,552,972 and 3,655,387, Japanese Patent Publication No. 9610/76, Japanese Patent Application (OPI) Nos. 29715/78, 89626/79, 203435/83 and 208743/83 (the term "OPI" as used herein refers to a "published unexamined Japanese patent application"), and *Shin Kaimen-kasseizai* (*New Surface Active Agent*), written by Hiroshi Horiguchi (Sankyo Shuppan, 1975).

In the following, examples of nonionic surface active agents suitably used in the present invention are described.

$C_{11}H_{33}COO(CH_2CH_2O)_8H$ I-11

$C_{15}H_{31}COO(CH_2CH_2O)_{15}H$ I-12

$C_{17}H_{33}COO(CH_2CH_2O)_{15}H$ I-13

$C_8H_{17}O(CH_2CH_2O)_7H$ I-14

$C_{16}H_{33}O(CH_2CH_2O)_{12}H$ I-15

$C_{22}H_{45}O(CH_2CH_2O)_{25}H$ I-16

I-17

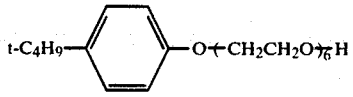

I-18

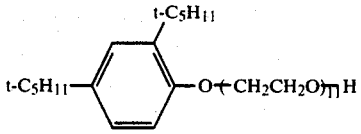

I-19

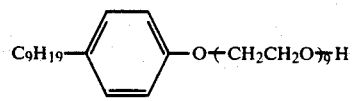

I-20

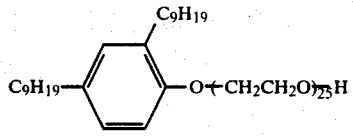

I-21

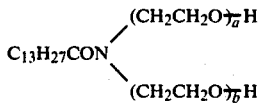

a + b = 15

I-22

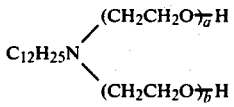

a + b = 20

I-23

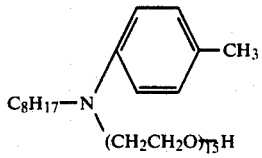

$C_{12}H_{25}S(CH_2CH_2O)_{16}H$ I-24

$C_{12}H_{25}O(CH(CH_3)CH_2O)_3(CH_2CH_2O)_{15}H$ I-25

-continued

I-26

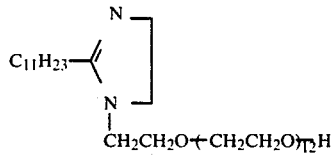

I-27

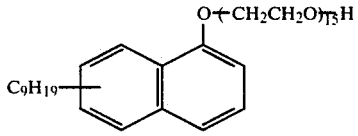

I-28

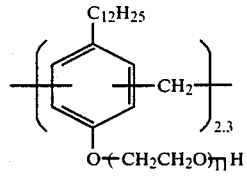

I-29

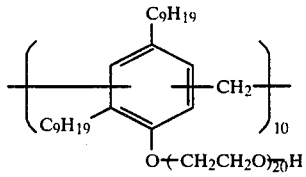

I-30

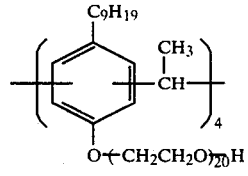

I-31

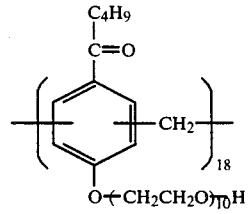

I-32

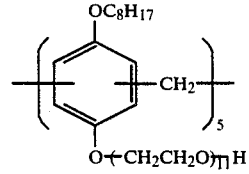

I-33

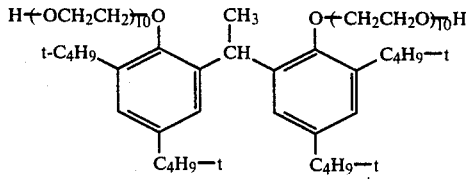

I-34

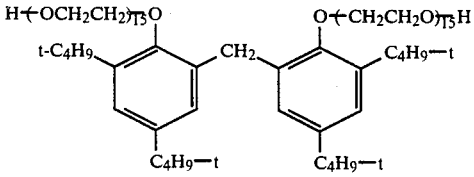

-continued

I-35

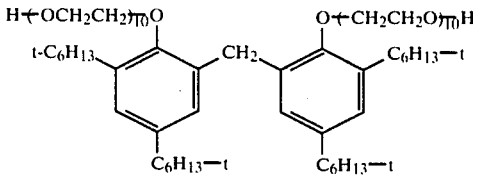

I-36

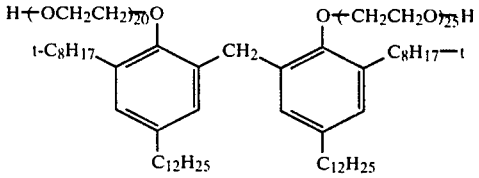

I-37

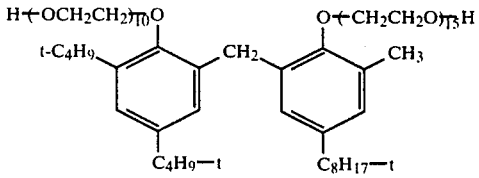

As typical examples of the silicone type slipping agent used in the emulsion protective layer of the present invention, there are silicone type slipping agents described in, for example, U.S. Pat. No. 3,042,522, British Pat. No. 955,061, U.S. Pat. Nos. 3,080,317, 4,004,927, 4,047,958 and 3,489,567 and British Pat. No. 1,143,118.

In the present invention, the following alkyl polysiloxanes represented by the general formulae (II-1), (II-2) and (II-3) are desirably used.

Preferably, an alkyl polysiloxane having a polyoxyalkylene chain in the side chain represented by the general formula (II-1) and an alkyl polysiloxane represented by the general formula (II-2) are used.

(II-1)

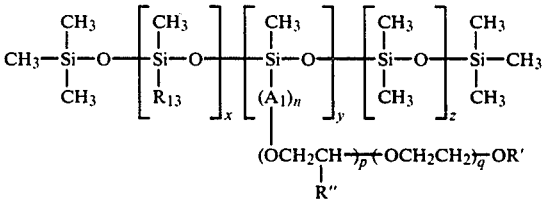

In the formula, $R_{13}$ represents an aliphatic group (for example, an alkyl group (preferably that having 1 to 18 carbon atoms), a substituted alkyl group (for example, an aralkyl group, an alkoxyalkyl group, an aryloxyalkyl group, etc.), or an aryl group (for example, a phenyl group, etc.). R′ represents a hydrogen atom, an aliphatic group (for example, an alkyl group (preferably that having 1 to 12 carbon atoms), a substituted alkyl group, etc.) or an aryl group (for example, a phenyl group, etc.). R″ represents an alkyl group (for example, a methyl group, etc.) or an alkoxyalkyl group (for example, a methoxymethyl group, etc.). $A_1$ represents a divalent residue of an aliphatic hydrocarbon. n is 0 or an integer of 1 to 12 (preferably 2 to 5), p is a number of 0 to 50 (preferably 2 to 30), q is a number of 2 to 50 (preferably 2 to 30), x is a number of 0 to 100, y is a number of 1 to 50, z is a number of 0 to 100, and x+y+z is a number of 5 to 250 (preferably 10 to 50).

Examples of $R_{13}$ include a methyl, ethyl, propyl, pentyl, cyclopentyl, cyclohexyl, dimethylpentyl, heptyl, methylhexyl, octyl, dodecyl, octadecyl, phenylethyl, methylphenylethyl, phenylpropyl, cyclohexylpropyl, benzyloxypropyl, phenoxypropyl, ethyloxypropyl, butyloxyethyl, phenyl group, etc.

As groups represented by $A_1$, there are a methylene, 1-one-trimethylene, 2-methyl-1-one-trimethylene group, etc.

As alkyl groups represented by R', there are a methyl, ethyl, propyl, butyl, amyl, hexyl, heptyl, octyl, nonyl, decyl and dodecyl group.

(II-2)

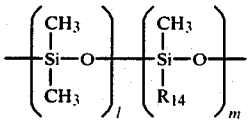

The general formula (II-2) includes cyclic siloxanes having a siloxane unit represented by the following general formula (II-2-1) and straight chain siloxanes having a siloxane unit represented by the general formula (II-2-1) and an end group represented by the following general formula (II-2-2).

(II-2-1)

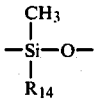

(II-2-2)

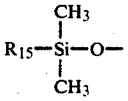

In the formulae, $R_{14}$ represents an alkyl, cycloalyl or alkoxyalkyl group having 5 to 20 carbon atoms, an aralkyl group, an aryloxyalkyl group or a glycidyloxyalkyl group.

$R_{15}$ represents an alkyl group having 1 to 20 carbon atoms or a cycloalkyl, alkoxyalkyl, aralkyl, aryloxyalkyl or glycedyloxyalkyl group each having 5 to 20 carbon atoms.

l represents 0 or a number of 1 or more, m represents a number of 1 or more, and l+m represents a number of 1 to 1,000. Preferably l+m is 2 to 500.

Examples of $R_{14}$ in the compounds represented by the general formula (II-2) include a pentyl, methylpentyl cyclopentyl, cyclohexyl, dimethylpentyl, heptyl, methylhexyl, octyl, eicosyl, phenylethyl, methylphenylethyl, phenylpropyl, cyclohexylpropyl, benzyloxypropyl, phenoxypropyl, tolyloxypropyl, naphthylpropyl, ethyloxypropyl, butyloxyethyl, octadecyloxypropyl, glycidyloxypropyl, glycidyloxybutyl group, etc.

(II-3)

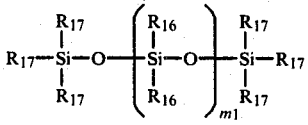

In the formula, $R_{16}$ represents an alkyl group having 1 to 3 carbon atoms, and $R_{17}$ represents an alkyl group having 1 to 3 carbon atoms or an alkoxy group having 1 or 2 carbon atoms. $m_1$ is 0 or an integer of 1 to 2,000.

In the following, typical examples of the compounds represented by the general formula (II-1) are described.

(II-1-a)

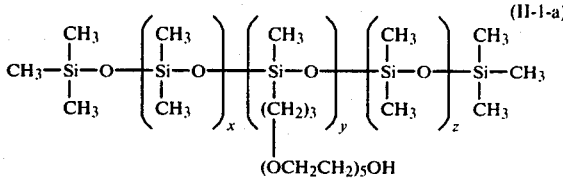

x + y + z = 30

(II-1-b)

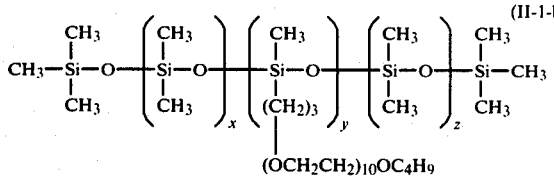

x + y + z = 40

(II-1-c)

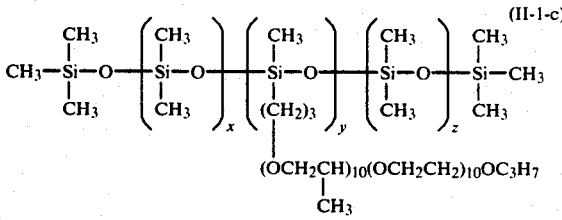

x + y + z = 35

(II-1-d)

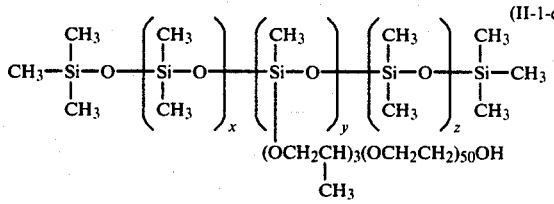

x + y + z = 50

(II-1-e)

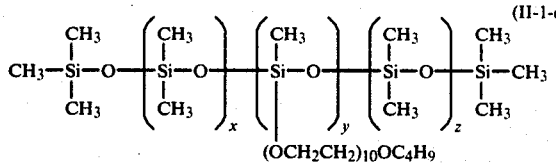

x + y + z = 100

(II-1-f)

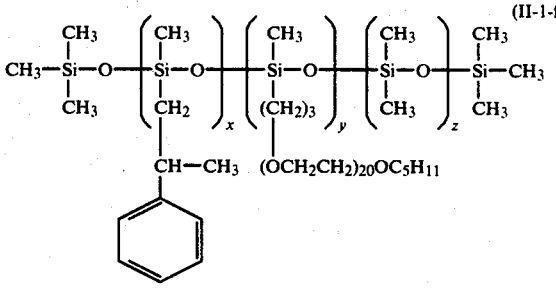

x + y + z = 40

(II-1-g)

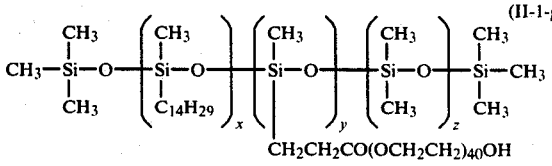

x + y + z = 200

-continued
(II-1-h)
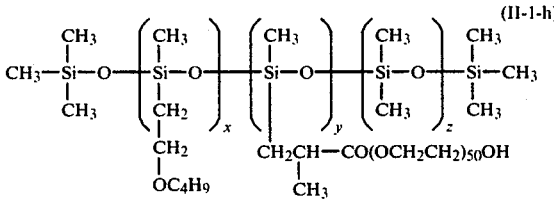
x + y + z = 35
(II-1-i)
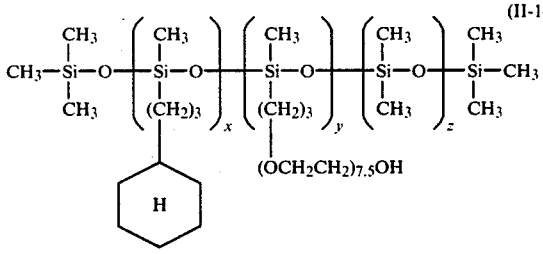
x + y + z = 10
(II-1-j)
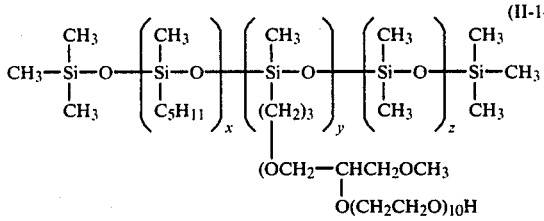
x + y + z = 30
(II-1-k)
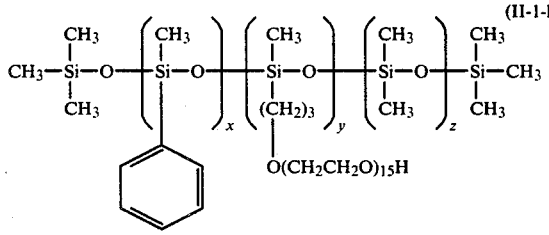
x + y + z = 60
In the following, typical examples of the compounds represented by the general formula (II-2) are described.
(II-2-a)
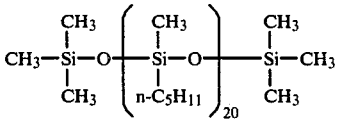
(II-2-b)
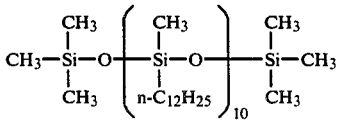
(II-2-c)
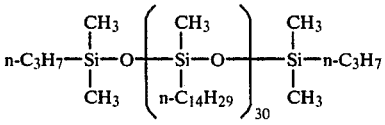
-continued
(II-2-d)
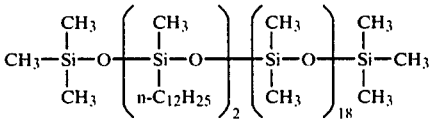
(II-2-e)
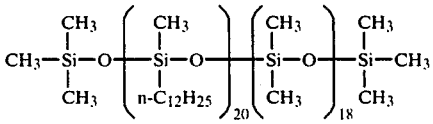
(II-2-f)
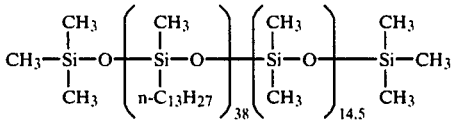
(II-2-g)
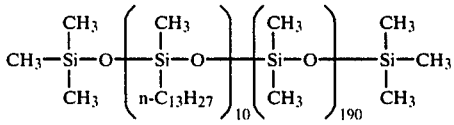
(II-2-h)
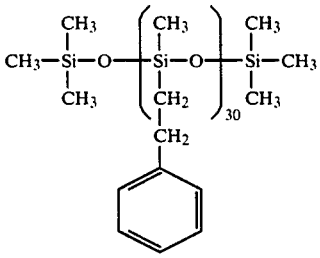
(II-2-i)
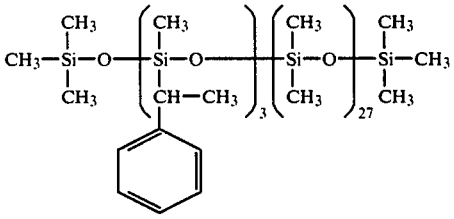
(II-2-j)
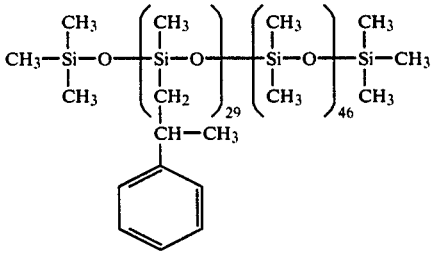
(II-2-k)
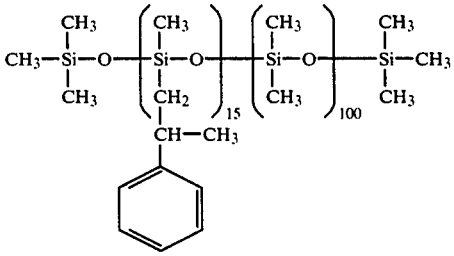

-continued (II-2-l)

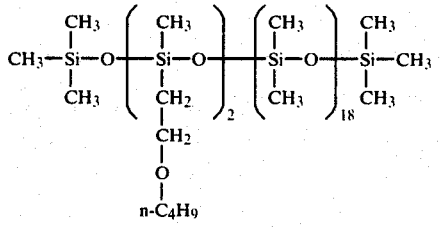

(II-2-m)

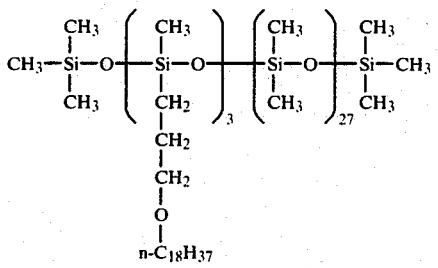

((II-2-n)

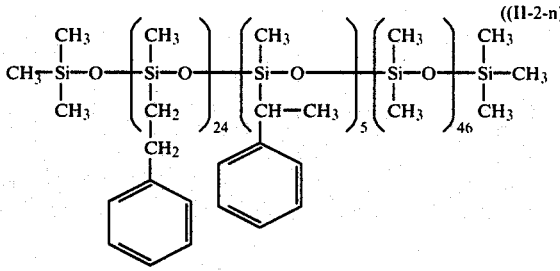

(II-2-o)

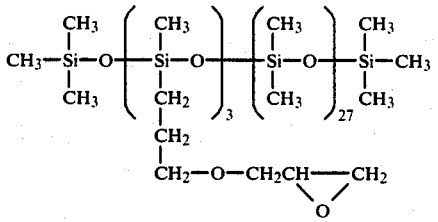

(II-2-p)

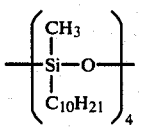

(II-2-q)

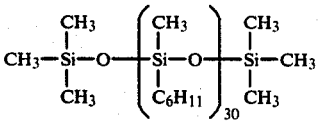

(II-2-r)

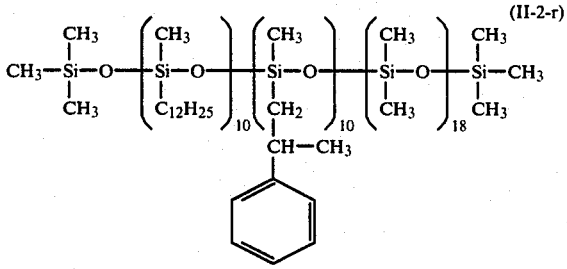

-continued (II-2-s)

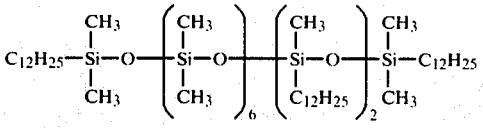

(II-2-t)

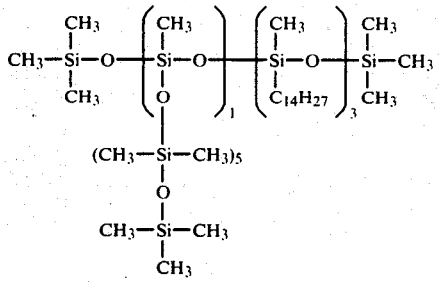

In the following, typical examples of the compounds represented by the general formula (II-3) are described.

(II-3-a)

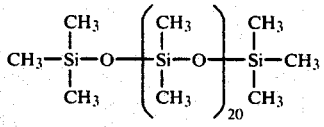

(II-3-b)

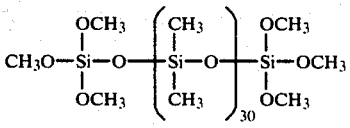

The polyoxyethylene type surface active agent and the silicone type slipping agent of the present invention are incorporated in the emulsion protective layer. The emulsion protective layer may be comprised of one layer or two layers, and when it is comprised of two layers, the surface active agent and the slipping agent of the present invention are preferably incorporated in the upper layer thereof.

In order to apply the polyoxyethylene type surface active agent and the silicone type slipping agent of the present invention to the hydrophilic colloid layer such as the emulsion protective layer, etc., they are added to a coating solution for the hydrophilic colloid layer such as the protective layer after they are dissolved in water or an organic solvent such as methanol, isopropanol or acetone, etc., or a mixture thereof, and the coating solution is applied by a dip coating process, an air knife coating process or an extrusion coating process using a hopper described in U.S. Pat. No. 2,681,294, or two or more layers are applied simultaneously by processes described in U.S. Pat. Nos. 3,508,947, 2,941,898 and 3,526,528, etc., or the hydrophilic colloid layer is immersed in the coating solution containing the compound of the present invention.

The polyoxyethylene type surface active agent and the silicone type slipping agent of the present invention are preferred to be used in an amount of 0.005 to 2.0 g, particularly 0.010 to 0.10 g, per square meter of the photographic light-sensitive material, respectively.

However, the above described range varies, of course, according to kinds of the photographic film base used, photographic composition, configuration or coating process.

As materials used as the base of the photographic light-sensitive materials of the present invention, there are, for example, cellulose nitrate films, cellulose acetate films, cellulose acetate butyrate films, cellulose acetate propionate films, polystyrene films, polyethylene terephthalate films, polycarbonate films and laminated materials of them.

The thickness of the backing layer in the present invention is 0.1 to 10 μm, preferably 0.5 to 5 μm and more preferably 1.0 to 3.0 μm, and the amount of the matting agent contained in the backing layer is 0.01 to 1 $g/m^2$, preferably 0.1 to 0.5 $g/m^2$. The matting agent is preferred to have a size of 3.5 to 6.0 μm.

In the photographic light-sensitive materials of the present invention, each photographic constituent layer can contain the following binder.

As examples of hydrophilic colloids, there are proteins such as gelatin, colloidal albumin, casein, etc.; cellulose compounds such as carboxymethyl cellulose, hydroxyethyl cellulose, etc.; sugar derivatives such as agar, sodium alginate, starch derivatives, etc.; and synthetic hydrophilic colloids, such as polyvinyl alcohol, pol-N-vinylpyrrolidone, polyacrylic acid copolymer, polyacrylamide or derivatives thereof and partially hydrolyzed products thereof, etc. If necessary, two or more of these colloids are used as a mixture.

The most available substance of them is gelatin. The term "gelatin" means the so-called lime processed gelatin, acid processed gelatin and enzyme processed gelatin.

The photographic emulsions can be subjected to, if necessary, spectral sensitization or supersensitization using polymethine sensitizing dyes such as cyanine, merocyanine, carbocyanine, etc., alone or in combination or using a combination of the above described dyes and styryl dyes.

The photographic emulsions of the photographic light-sensitive materials used in the present invention may contain various compounds for the purpose of preventing decrease of sensitivity or occurrence of fog in the step of production of the light-sensitive materials, during preservation or during processing. As such compounds, quite many compounds such as heterocyclic compounds including 4-hydroxy-6-methyl-1,3,3a,7-tetraazaindene-3-methylbenzothiazole and 1-phenyl-5-mercaptotetrazole, mercury containing compounds, mercapto compounds, metal salts, etc., have been known.

In the case that silver halide photographic emulsions are used for a color photographic light-sensitive material, couplers may be incorporated in the silver halide emulsion layers. As such couplers, 4-equivalent type diketomethylene yellow couplers, 2-equivalent type diketomethylene yellow couplers, 4-equivalent type or 2-equivalent type pyrazolone magenta couplers and indazolone magenta couplers, naphthol cyan couplers and phenol cyan couplers, etc., can be used.

To the photographic constituent layers of the present invention, surface active agents other than the polyoxyethylene type compounds of the present invention may be added alone or as a mixture. They are used as coating aids, but, in some cases, they are used for another purpose, for example, emulsification and dispersion, improvement of photographic characteristics such as sensitization, or control of triboelectric series.

These surface active agents are classified into natural surface active agents such as saponin, etc., nonionic surface active agents such as alkylene oxide type, glycerin type and glycidol type agents, cationic surface active agents such as higher alkylamines, quaternary ammonium salts, pyridines and other heterocyclic compounds, phosphonium or sulfonium compounds, etc., anionic surface active agents containing acid groups such as carboxylic acid, sulfuric acid, phosphoric acid, sulfuric acid ester or phosphoric acid ester, etc., and ampholytic surface active agents such as amino acids, aminosulfonic acids, sulfuric or phosphoric acid esters of amino alcohols, etc., as well as fluorine containing surface active agents.

A part of examples of compounds capable of using as the surface active agent are described in British Pat. Nos. 1,330,356 and 1,524,631, U.S. Pat. Nos. 3,666,478 and 3,589,906, Japanese Patent Publication No. 26687/77, Japanese Patent Application (OPI) Nos. 46733/74 and 32322/76, U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974 and 3,507,660, British Pat. No. 1,198,450, and literature such as Ryohei Oda, *Kaimenkasseizai no Gosei to sono Oyo* (Maki Shoten, 1964), A. W. Perry, *Surface Active Agents* (Interscience Publication Incorporated, 1978), and J. P. Sisley, *Encyclopedia of Active Agents,* Vol. 2 (Chemical Publish Company, 1964).

In the photographic constituent layers of the photographic light-sensitive materials of the present invention, ultraviolet ray absorbing agents as described in U.S. Pat. Nos. 3,253,921, 3,707,375, 3,271,156, 3,794,493, 3,698,907 and 4,195,999 and Japanese Patent Application (OPI) No. 56620/76 can be incorporated by emulsion dispersing or latex dispersing.

According to the present invention, problems caused by friction or static electricity in the case of using the photographic light-sensitive materials have been improved.

In the following, the effect of the present invention is illustrated with reference to examples. However, the present invention is not restricted to them.

EXAMPLE 1

A backing solution prepared by adding the compound shown in Table 1 as a matting agent, sodium p-dodecylbenzenesulfonate as a coating aid (0.05 $g/m^2$), potassium polystyrenesulfonate as a viscosity increasing agent (0.02 $g/m^2$) and 2-hydroxy-4,6-dichloro-1,3,5-triazine as a hardener (0.07 $g/m^2$) to a gelatin binder was applied to a cellulose triacetate base having an undercoated layer so as to result in a coating amount of gelatin of 3.0 $g/m^2$. A silver halide emulsion having a halide composition consisting of 98% by mol of silver bromide and 2% by mol of silver iodide was prepared by carrying out gold sensitization and sulfur sensitization. This emulsion was chemically sensitized with anhydrous 5',6'-dichloro-1',3-diethyl-3'-(3-sulfopropyl)-benzimidazolooxacarbocyanine hydroxide as a sensitizing dye. After the same substances as in the backing layer were added as the coating aid (0.01 $g/m^2$), the viscosity increasing agent (0.02 $g/m^2$) and the hardener (0.06 $g/m^2$), the emulsion was applied to the reverse side of the cellulose triacetate base having an undercoating layer on which the backing layer was present, so as to result in a coating amount of silver of 1.4 $g/m^2$. Further, in order to form an emulsion protective layer, the same coating aid (20 mg/m$^2$), the same viscosity increasing agent (0.01 g/m$^2$) and the same hardener (0.02 g/m$^2$) as those described above were added to gelatin to be used as a binder, and polymethyl methacrylate (average particle size 2.5 μm) was added as a matting agent in an amount of 0.15 g/m$^2$. Further, as a surface agent, the compound shown in Table 1 was added, and the emulsion was applied so as to result in a coating amount of gelatin of 1.3 g/m$^2$.

The resulting sample which was not exposed to light was allowed to stand in a rolled state at a temperature of 25° C. and a humidity of 60% RH for 1 week. After the sample was conditioned at 25° C. and 25% RH for 2 hours, it was rubbed by a white Neoprene rubber roll in a dark room under the same conditioning condition as described above. It was then developed with a conventional developing solution, fixed and washed with water, and the degree of occurrence of static mark was examined. The results obtained are shown in Table 1.

TABLE 1

| Sample No. | Matting Agent (backing layer) Compound | Average Particle Size (μm) | Coating Amount (g/m$^2$) | Surface Improving Agent (emulsion protective layer) Compound | Coating Amount (g/m$^2$) | Degree of Occurrence of Static Mark | Static Friction Coefficient |
|---|---|---|---|---|---|---|---|
| 1-1 | — | — | — | I-28 | 0.040 | D | 0.36 |
| 1-2 | — | — | — | I-28<br>II-1-a | 0.040<br>0.050 | D | 0.38 |
| 1-3 | Silicon dioxide | 2.5 | 0.20 | I-28 | 0.040 | C | 0.35 |
| 1-4 | Silicon dioxide | 3.6 | " | I-28 | 0.040 | C | 0.32 |
| 1-5 | Polymethyl methacrylate | 2.7 | " | I-28<br>II-1-a | 0.040<br>0.050 | C | 0.33 |
| 1-6 (Invention) | Polymethyl methacrylate | 3.7 | " | I-28<br>II-1-a | 0.040<br>0.050 | A | 0.15 |
| 1-7 (Invention) | Polymethyl methacrylate | " | 0.05 | I-28 | 0.040 | A | 0.14 |
| 1-8 (Invention) | Copolymer of polymethyl methacrylate and polymethacrylate* | 3.5 | 0.10 | I-28 | 0.040 | A | 0.16 |
| 1-9 (Invention) | Copolymer of polymethyl methacrylate and polymethacrylate* | 3.5 | 0.20 | I-28 | 0.040 | A | 0.19 |
| 1-10 (Invention) | Starch | 4.0 | 0.20 | II-1-a | 0.050 | B | 0.11 |

*Copolymerization ratio: 6:4 by mol

In the above described table, the degree of occurrence of static mark was evaluated on the basis of the following four stages.

A: Occurrence of static mark was not observed at all.
B: Occurrence of static mark was slightly observed.
C: Occurrence of static mark was fairly observed.
D: Occurrence of static mark was observed on nearly the entire surface.

Measurement of static friction coefficient was carried out by a paper clip method described in T. Anvelt, J. F. Carroll, Jr. and L. J. Sugden, *J. SMPTE,* 80 (9) 734–739 (1971), wherein the maximum static friction coefficient of the processed surface was measured at 25° C. and 60% RH.

It is obvious from Table 1 that the antistatic property and the slipping property are excellent in the samples in which the compounds of the present invention are used for improving the surface properties.

EXAMPLE 2

Samples 2-1 to 2-10 wherein a back layer and a protective layer for the back layer were applied to one side of a cellulose triacetate base and an antihalation layer, a red-sensitive layer, an intermediate layer, a green-sensitive layer, a yellow filter layer, a blue-sensitive layer and a protective layer were applied to the other side in this order, were produced by applying and drying according to conventional methods. The compositions of each layer are described in the following.

Back Layer

Binder: Lime processed gelatin 6.2 g/m$^2$
Hardener: 1,3-Bis(vinylsulfonyl)propanol-2 0.6 g/100 g binder

Back Protective Layer

Binder: Lime processed gelatin 2.2 g/m$^2$
Hardener: 1,3-Bis(vinylsulfonyl)propanol-2 1.2 g/100 g binder
Coating aid:

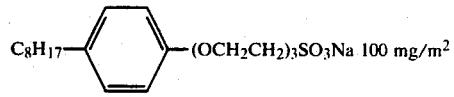

Antihalation Layer

Binder: Gelatin 4.4 g/m$^2$
Hardener: 1,3-Bis(vinylsulfonyl)propanol-2 1.2 g/100 g binder
Coating aid: Sodium dodecylbenzenesulfonate 4 mg/m$^2$
Antihalation component: Black colloidal silver 0.4 g/m$^2$

Red-Sensitive Layer

Binder: Gelatin 7 g/m$^2$
Hardener: 1,3-Bis(vinylsulfonyl)propanol-2 1.2 g/100 g binder
Coating aid: Sodium dodecylbenzenesulfonate 10 mg/m$^2$
Coating amount of silver: 3.1 g/m$^2$
Composition of silver halide: $AgI_2$ 2% by mol and AgBr 98% by mol
Antifogging agent: 4-Hydroxy-6-methyl-1,3,3a,7-tetraazaindene 0.9 g/Ag 100 g Coupler: 1-Hydroxy-4-(2-acetylphenyl)azo-N-[4-(2,4-di-tert-amylphenoxy)butyl]-2-naphthamide 38 g/Ag 100 g Sensitizing dye: Anhydro-5,5'-dichloro-9-ethyl-3,3'-di(3-sulfopropyl)thiacarbocyanine hydroxide.-pyridinium salt 0.3 g/Ag 100 g Intermediate Layer Binder: Gelatin 2.6 g/m$^2$ Hardener: 1,3-Bis(vinylsulfonyl)propanol-2 1.2 g/100 g binder Coating aid: Sodium dodecylbenzenesulfonate 12 mg/m$^2$ Green-Sensitive Layer Binder: Gelatin 6.4 g/m$^2$ Hardener: 1,3-Bis(vinylsulfonyl)propanol-2 1.2 g/100 g binder Coating aid: Sodium dodecylbenzenesulfonate 9 mg/m$^2$ Coating amount of silver: 2.2 g/m$^2$ Composition of silver halide: AgI 3.3% by mol and AgBr 96.7% by mol Stabilizer: 4-Hydroxy-6-methyl-1,3,3a,7-tetraazaindene 0.6 g/Ag 100 g Coupler: 1-(2,4,6-Trichlorophenyl)-3-[3-(2,4-di-tert-amylphenoxy)acetamido]benzamido-4-(4-methoxyphenyl)azo-5-pyrazolone 37 g/Ag 100 g Sensitizing dye: Anhydro-5,5'-diphenyl-9-ethyl-3,3'-di(2-sulfoethyl)oxacarbocyanine hydroxide. pyridinium salt 0.3 g/Ag 100 g Yellow Filter Layer Binder: Gelatin 2.3 g/m$^2$ Filter component: Yellow colloidal silver 0.7 g/m$^2$ Hardener: 1,3-Bis(vinylsulfonyl)propanol-2 1.2 g/100 g binder Surface active agent: 2-Sulfosuccinic acid bis(2-ethylhexyl)ester.sodium salt 7 mg/m$^2$ Blue-Sensitive Layer Binder: Gelatin 7 g/m$^2$ Hardener: 1,3-Bis(vinylsulfonyl)propanol-2 1.2 g/100 g binder Coating aid: Sodium dodecylbenzenesulfonate 8 mg/m$^2$ Coating amount of silver: 2.2 g/m$^2$ Composition of silver halide: AgI 3.3% by mol and AgBr 96.7% by mol Stabilizer: 4-Hydroxy-6-methyl-1,3,3a,7-tetraazaindene 0.4 g/Ag 100 g Coupler: 2'-Chloro-5'-[2-(2,4-di-tert-amylphenoxy)-butyramido]-α-(5,5'-dimethyl-2,4-dioxo-3-oxazolidinyl)-α-(4-methoxybenzoyl)acetanilide 45 g/Ag 100 g Protective Layer Binder: Gelatin 2 g/m$^2$ Hardener: 1,3-Bis(vinylsulfonyl)propanol-2 1.2 g/100 g binder Coating aid: Dioctylsulfosuccinic acid sodium salt 5 mg/m$^2$ In the above described compositions, the compounds described in Table 2 were added to the emulsion protective layer and the backing protective layer.

After the resulting samples were allowed to stand in a rolled state at 25° C. and 60% RH for 1 week, the antistatic property and the slipping property of them were examined by the same manner as in Example 1. The results are shown in Table 2.

TABLE 2

| | Matting Agent (backing protective layer) | | | Surface Improving Agent (emulsion protective layer) | | Degree of Occurrence | |
|---|---|---|---|---|---|---|---|
| Sample No. | Compound | Average Particle Size (μm) | Coating Amount (g/m$^2$) | Compound | Coating Amount (g/m$^2$) | of Static Mark | Static Friction Coefficient |
| 2-1 | — | — | — | I-15 | 0.030 | D | 0.38 |
| 2-2 | — | — | — | II-3-a | 0.100 | D | 0.36 |
| 2-3 | Silicon dioxide | 2.5 | 0.20 | I-15 | 0.030 | C | 0.38 |
| 2-4 | Silicon dioxide | 3.6 | " | I-15 | 0.030 | D | 0.41 |
| 2-5 | Polymethyl methacrylate | 2.7 | " | I-15 | 0.030 | C | 0.37 |
| 2-6 (Invention) | Polymethyl methacrylate | 3.7 | " | I-15 | 0.030 | A | 0.16 |
| 2-7 (Invention) | Polymethyl methacrylate | 3.7 | " | II-3-a | 0.10 | A | 0.15 |
| 2-8 (Invention) | Polymethyl methacrylate | 3.7 | 0.03 | II-3-a | 0.10 | A | 0.18 |
| 2-9 (Invention) | Polymethyl methacrylate | 3.7 | " | I-15<br>II-3-a | 0.030<br>0.10 | A | 0.13 |
| 2-10 (Invention) | Glycidyl acrylate polymer | 4.1 | 0.25 | II-3-a | 0.030 | A | 0.14 |

It is obvious from Table 2 that samples in which the surface was improved with the compounds of the present invention show a good antistatic property and a good slipping property.

While the invention has been described in detail and with reference to specific embodiments thereof, it will be apparent to one skilled in the art that various changes and modifications can be made therein without departing from the spirit and scope thereof.

What is claimed is:

1. In silver halide photographic light-sensitive materials comprising at least one silver halide photographic emulsion layer on one side of a base and an emulsion protective layer thereon, and a hydrophilic colloid backing layer on the other side of the base, the improvement wherein said backing layer contains a polymer matting agent present in an amount from 0.01 to 1 g/m$^2$, and having an average particle size of 3.0 to 6.0 μm and being selected from the group consisting of a methyl methacrylate homopolymer, a methyl methacrylate-vinyl monomer copolymer, a glycidyl acrylate homopolymer and starch, and said emulsion protective layer contains at least one of a polyoxyethylene type surface active agent in an amount of from 0.005 to 2.0 g/m$^2$ of the photographic light-sensitive material and a silicone type slipping agent in an amount of from 0.005 to 2.0 g/m$^2$ of the photographic light-sensitive material.

2. The silver halide photographic light-sensitive material as claimed in claim 1, wherein said polyoxyethylene type surface active agent is represented by the following general formula (I-1), (I-2) or (I-3):

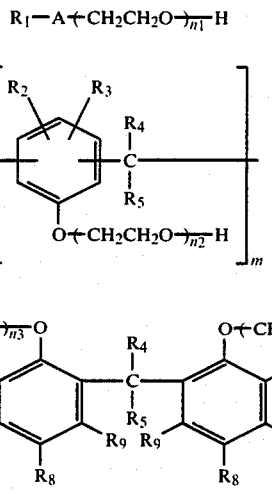

(I-1)

(I-2)

(I-3)

wherein $R_1$ represents a substituted or unsubstituted alkyl group having 1 to 30 carbon atoms, a substituted or unsubstituted alkenyl group or a substituted or unsubstituted aryl group, A represents —O—, —S—, —COO—, $$-\underset{|}{N}-R_{10},\quad -CO-\underset{|}{N}-R_{10}\quad \text{or}\quad -SO_2\underset{|}{N}-R_{10}$$

(wherein $R_{10}$ represents a hydrogen atom or a substituted or unsubstituted alkyl group; $R_2$, $R_3$, $R_7$ and $R_9$ each represents a hydrogen atom, a substituted or unsubstituted alkyl group, a substituted or unsubstituted aryl group, a substituted or unsubstituted alkoxy group, a halogen atom, an acyl group, an amide group, a sulfonamide group, a carbamoyl group or a sulfamoyl group; $R_6$ and $R_8$ each represents a substituted or unsubstituted alkyl group, a substituted or unsubstituted aryl group, a substituted or unsubstituted alkoxy group, a halogen atom, an acyl group, an amide group, a sulfonamide group, a carbamoyl group or a sulfamoyl group; $R_4$ and $R_5$ each represents a hydrogen atom, a substituted or unsubstituted alkyl group or a substituted or unsubstituted aryl group, $R_4$ and $R_5$, $R_6$ and $R_7$, and $R_8$ and $R_9$ may form a substituted or unsubstituted ring by bonding together, and $n_1$, $n_2$, $n_3$, $n_4$ and m each represents a number of 2 to 50.

3. The silver halide photographic light-sensitive material as claimed in claim 1, wherein said silicone type slipping agent is an alkyl polysiloxane represented by the following general formula (II-1), (II-2) or (II-3):

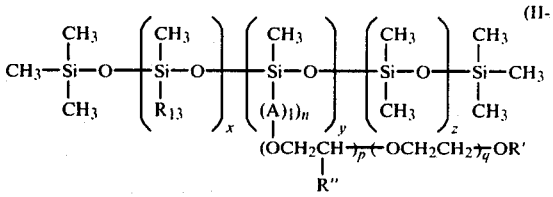

(II-1)

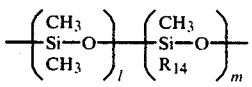

(II-2)

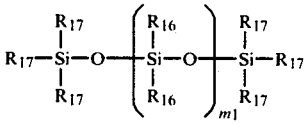

(II-3)

wherein $R_{13}$ represents an aliphatic group or an aryl group; R′ represents a hydrogen atom, an aliphatic group or an aryl group; R″ represents an alkyl group or an alkoxyalkyl group; $A_1$ represents a divalent residue of an aliphatic hydrocarbon; n represents 0 or an integer of 1 to 12; p represents a number of 0 to 50; q represents a number of 2 to 50; x represents a number of 0 to 100; y represents a number of 1 to 50; z represents a number of 0 to 100; $R_{14}$ represents an alkyl, cycloalkyl or alkoxyalkyl group having 5 to 20 carbon atoms, an aralkyl group, an aryloxyalkyl group or a glycidyloxyalkyl group; $R_{15}$ represents an alkyl group having 1 to 20 carbon atoms or a cycloalkyl, alkoxyalkyl, aralkyl, aryloxyalkyl or glycidyloxyalkyl group each having 5 to 20 carbon atoms; l represents a number of 0, 1 or more; m represents a number of 1 or more; and l+m is a number of 1 to 1,000; $R_{16}$ represents an alkyl group having 1 to 3 carbon atoms; and $R_{17}$ represents an alkyl group having 1 to 3 carbon atoms or an alkoxy group having 1 or 2 carbon atoms; and $m_1$ represents 0 or an integer of 1 to 2,000.

4. The silver halide photographic light-sensitive material as claimed in claim 1, wherein the amounts of said polyoxyethylene type surface active agent and silicone type slipping agent are each from 0.010 to 0.10 g per square meter of the photographic light-sensitive material.

5. The silver halide photographic light-sensitive material as claimed in claim 1, wherein said backing layer has a thickness of 0.1 to 10 μm.

6. The silver halide photographic light-sensitive material as claimed in claim 1, wherein the amount of said matting agent is from 0.1 to 0.5 g/m$^2$.

7. The silver halide photographic light-sensitive material as claimed in claim 1, wherein said matting agent has an average particle size of 3.5 to 6.0 μm.

8. The silver halide photographic light-sensitive material as claimed in claim 1, wherein said matting agent is a water dispersive vinyl polymer.

* * * * *